US007450073B2

(12) United States Patent
Sung et al.

(10) Patent No.: US 7,450,073 B2
(45) Date of Patent: Nov. 11, 2008

(54) ELECTRICAL APPARATUS

(75) Inventors: Cheng-Hsin Sung, Taipei (TW); Chuan-Kung Hou, Taipei County (TW); Chia-Hsien Lin, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 395 days.

(21) Appl. No.: 11/322,338

(22) Filed: Jan. 3, 2006

(65) Prior Publication Data

US 2006/0284782 A1 Dec. 21, 2006

(30) Foreign Application Priority Data

Jun. 20, 2005 (TW) ..... 94120448 A

(51) Int. Cl.
*H01Q 1/24* (2006.01)

(52) U.S. Cl. ..... 343/702

(58) Field of Classification Search ..... 343/702, 343/839, 915; 348/14.01, 14.02; 455/556.1
See application file for complete search history.

(56) References Cited

U.S. PATENT DOCUMENTS

| | | | | |
|---|---|---|---|---|
| 6,549,789 | B1 * | 4/2003 | Kfoury | 455/550.1 |
| 6,810,275 | B2 * | 10/2004 | Edwards et al. | 455/575.3 |
| 7,301,555 | B2 * | 11/2007 | Navntoft | 348/14.02 |
| 7,336,979 | B2 * | 2/2008 | Soejima | 455/575.1 |
| 2005/0159184 | A1 * | 7/2005 | Kerner et al. | 455/558 |
| 2005/0219372 | A1 * | 10/2005 | Watanabe | 348/207.99 |
| 2007/0002543 | A1 * | 1/2007 | Nord | 361/733 |

* cited by examiner

*Primary Examiner*—Huedung Mancuso
(74) *Attorney, Agent, or Firm*—Rabin & Berdo, P.C.

(57) ABSTRACT

An electrical apparatus with a rotating stage set pivotally connecting to a host shell, and an antenna module pivotally connecting to the rotating stage set is provided. The rotating stage set rotates about the X-axis, and the antenna module rotates about the Y-axis with respect to the host shell. In addition, the electrical apparatus can thus obtain the best signal receiving and transmitting efficiency by adjusting the antenna module to the best receiving and transmitting position and angle.

44 Claims, 19 Drawing Sheets

ELECTRICAL APPARATUS

CROSS-REFERENCE TO RELATED APPLICATIONS

This non-provisional application claims priority under 35 U.S.C. § 119(a) on Patent Application No(s). 94120448 filed in Taiwan, R.O.C. on Jun. 20, 2005, the entire contents of which are hereby incorporated by reference.

BACKGROUND OF THE INVENTION

1. Field of Invention

The invention relates to an antenna module adopted for use on an electrical apparatus, and particularly to an antenna module that can be swiveled to a desired angle and adjusted to an optimum position and angle for receiving and transmitting to achieve maximum signal receiving and transmitting efficiency.

2. Related Art

With technology advancing rapidly, surfing the Internet and transmitting and receiving data wirelessly have become basic functional requirements on electrical apparatuses. Through wireless transmission users can not only access the Internet to receive and transmit the most updated data, they can also get in touch with cutting edge technologies anytime, anywhere. The general portable electrical apparatus, such as the mobile phone, watch, notebook computer, or wireless Web surfing device all use an antenna to transmit data.

In general, the antenna is pivotally coupled on an electrical apparatus through a hinge or an anchor seat so that it may be swiveled or turned relative to the electrical apparatus to change the receiving position, angle, polarization direction, and so on. This enables users to make adjustments during operation to reach an optimum position and angle for receiving and transmitting to achieve maximum signal receiving and transmitting efficiency. Now many electrical apparatus are designed to be viewed in various angles. The antenna thus also must provide a swivel function to achieve the optimum receiving and transmitting efficiency.

In order to anchor the antenna in the optimum receiving and transmitting location, an position means has to be provided. Most position devices now available on the market adopt the design of anchor holes and pins, or folding elements that are coupled tightly.

SUMMARY OF THE INVENTION

In view of the aforesaid problems, the object of the invention is to provide an electrical apparatus with an antenna module that can be swiveled to a desired angle and adjusted to an optimum position and angle for receiving and transmitting angle to achieve maximum signal receiving and transmitting efficiency.

To achieve the foregoing object, the electrical apparatus according to the present invention includes a host module, a rotating stage set and an antenna module. The host module includes a host and a host shell that encases the host. The rotating stage set is pivotally coupled on the host shell and includes a pivot spot on one side to be hinged on the host shell to serve as the rotation axis of the rotating stage set. Thereby the rotating stage set can be swiveled axially relative to the host shell. The antenna module has one side hinged on the rotating stage set and can be swiveled relative to the rotating stage set about another axis.

By means of the aforesaid design, the rotating stage set and antenna module can be swiveled relative to the host shell.

Thus, the antenna module can be swiveled and adjusted to an optimum position and angle for receiving and transmitting to achieve maximum signal receiving and transmitting efficiency.

Furthermore, in general, the host of the host module and the antenna of the antenna module are bridged by a connection line to transmit signals between them. In the invention, the connection line is connected to the host of the host module and then threaded through grooves formed on various elements and connected to the antenna of the antenna module.

Further scope of applicability of the invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Figure 1A:
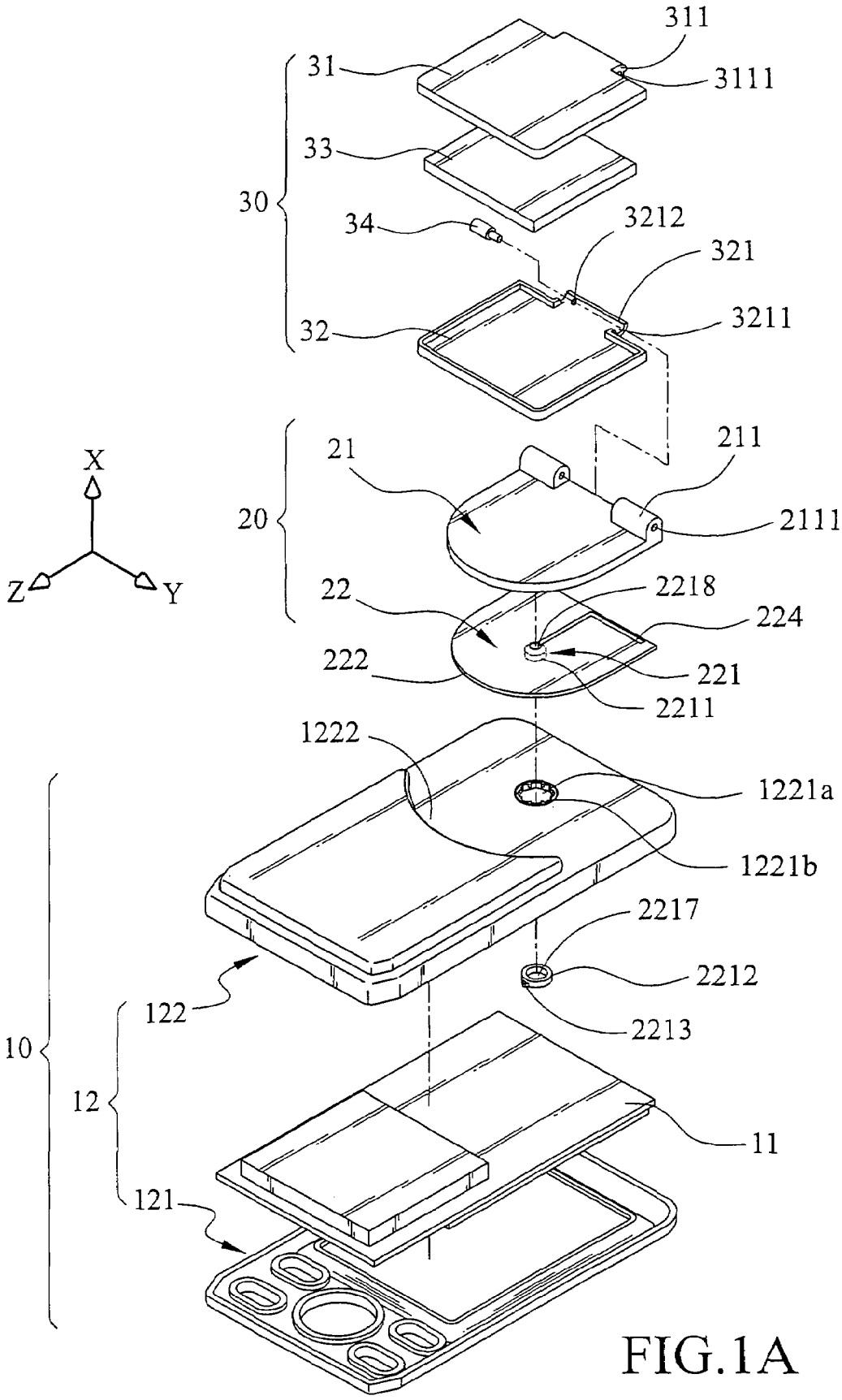
FIG. 1A is an exploded view of an embodiment of the invention.
Figure 1B:
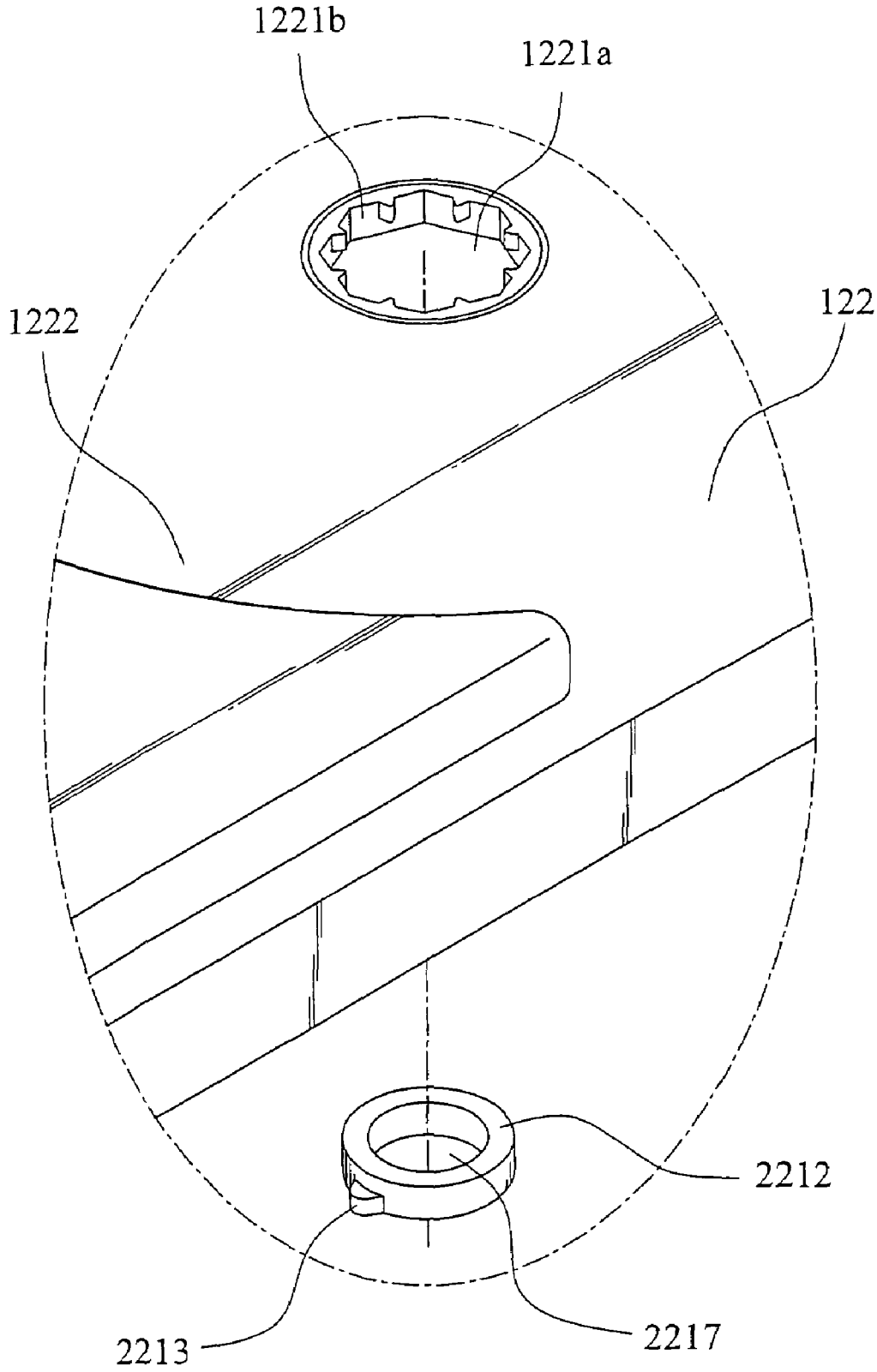
FIG. 1B is a fragmentary enlarged view of an embodiment of the invention.

Refer to FIG. 1A for an exploded view and FIG. 1B for a fragmentary enlarged view of an embodiment of the invention. The electrical apparatus according to the invention includes a host module 10, a rotating stage set 20, and an antenna module 30.

The host module 10 includes a host 11 and a host shell 12 that encases the host 11. It also has a front cover 121 and a back cover 122. The front cover 121 may dispose a screen and button keys, which are known in the prior art and thus omitted from this description. The back cover 122 has a pivot aperture 1221*a* and a plurality of anchor notches 1221*b* that are formed on the perimeter of the pivot aperture 1221*a*. The back cover 122 further has an arched trough 1222.

The rotating stage set 20 is hinged on the host shell 12, and includes a rotary upper lid 21 and a rotary lower lid 22. The rotary upper lid 21 is pivotally coupled with the antenna module 30, and has an axle hub 211 with a hole 2111. The rotary lower lid 22 is pivotally coupled with the host shell 12 and has a pivot spot 221 corresponding to the pivot aperture 1221*a*. The pivot spot 221 is hinged on the host shell 12 and serves as the rotation axis of the rotating stage set 20 so that the rotating stage set 20 can be swiveled relative to the host shell 12. The pivot spot 221 includes a coupling portion 2211 and a coupling axle 2212. The coupling portion 2211 runs through the pivot aperture 1221*a*. In addition, the coupling axle 2212 is pivotally coupled on the coupling portion 2211 to hinge the rotating stage set 20 on the host shell 12. The coupling axle 2212 further has a movable anchor lug 2213 to latch on the anchor notches 1221*b* and anchor the rotating stage set 20 on the host shell 12 at a selected position. Besides, the rotary lower lid 22 has an arched edge 222 corresponding to the arched trough 1222 of the rotary lower lid 22 to smooth swiveling of the rotating stage set 20.

The antenna module 30 has one side hinged on the rotating stage set 20 so that the antenna module 30 can swivel relative to the rotating stage set 20. The antenna module 30 includes an upper cap 31, a lower cap 32, an antenna 33 and a spindle 34. The upper cap 31 includes a pivot plate 311 that has a cavity 3111 corresponding to the hole 2111. The lower cap 32 has a shaft 321 located in the pivot plate 311. Also, the shaft 321 has an opening 3211 corresponding to the cavity 3111. The antenna 33 is held in a housing space formed between the upper cap 31 and the lower cap 32, and the spindle 34 runs through the cavity 3111 of the pivot plate 311 and the opening 3211 of the shaft 321 to couple the upper cap 31 and the lower cap 32 together. In addition, the spindle 34 is designed with an anchor function (which is a technique known in the art so details are omitted). The upper cap 31 and the lower cap 32 form the housing space to hold the antenna 33. The spindle 34 also runs through the hole 2111 of the axle hub 211 to couple the rotating stage set 20 and the antenna module 30.

Figure 2:
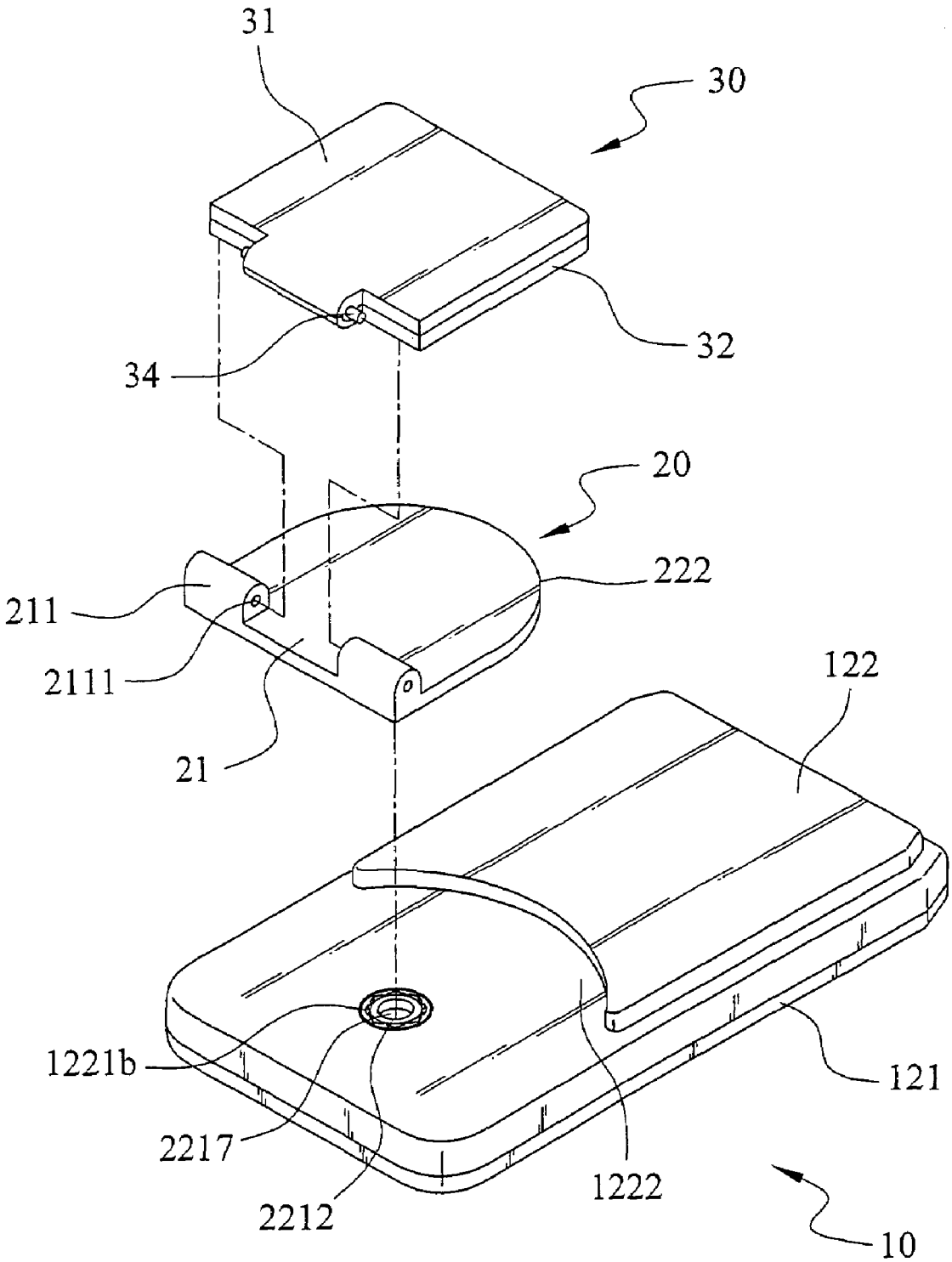
FIG. 2 is an assembly exploded view of an embodiment of the invention.
Figure 3:
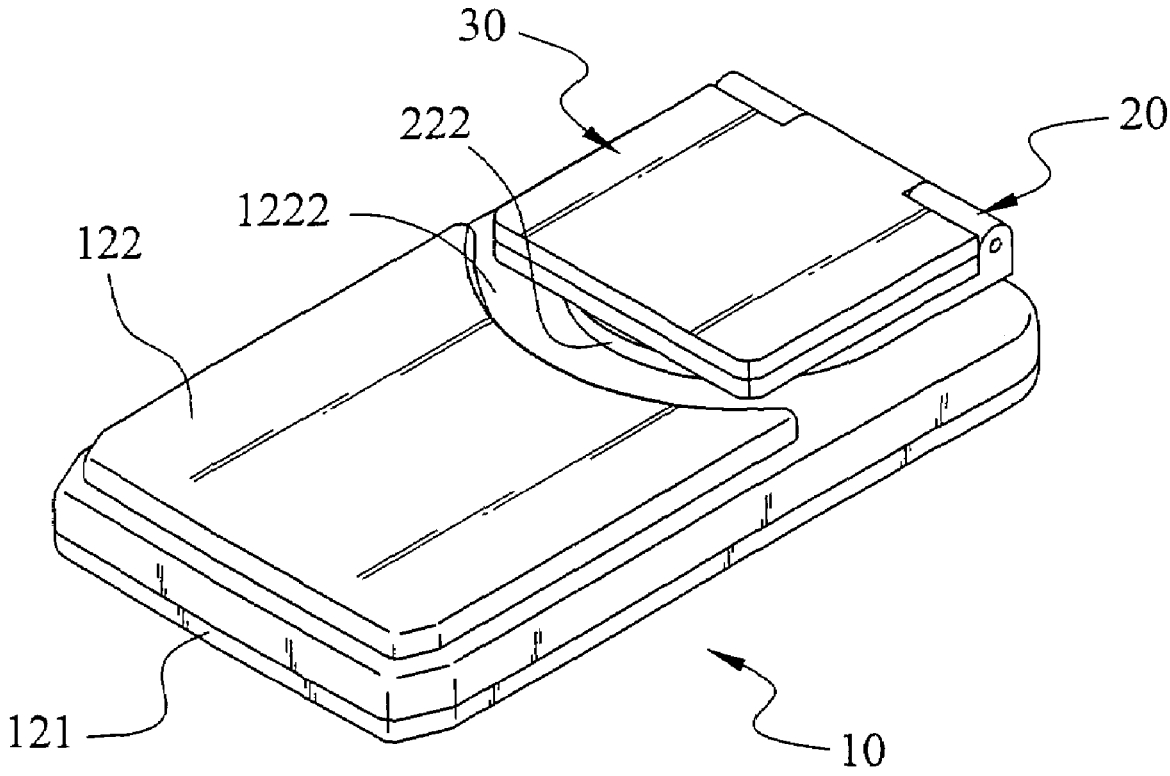
FIG. 3 is a perspective view of an embodiment of the invention in an assembled condition.

Referring to FIG. 2, an assembly exploded view of an embodiment of the invention is shown and referring to FIG. 3, a perspective view of an embodiment of the invention in an assembled condition is shown. To assemble the invention, first, have the pivot portion 2211 running through the pivot aperture 1221*a* and couple the coupling axle 2212 on the coupling portion 2211 to hinge the rotary lower lid 22 of the rotating stage set 20 on the back cover 122 of the host shell 12. Next, couple the front cover 121 and the back cover 122, and hold the host 11 between the front cover 121 and the back cover 122. Next, couple the rotary upper lid 21 and the rotary lower lid 22 of the rotating stage set 20; the coupling may be done by corresponding cavities or lugs, bonding or the like. Then hold the antenna 33 between the upper cap 31 and the lower cap 32 of the antenna module 30. Next, have the spindle 34 running through the cavity 3111 of the pivot plate 311 and the opening 3211 of the shaft 321 to couple the upper cap 31 and the lower cap 32. Meanwhile the spindle 34 also runs through the hole 2111 of the axle hub 211 to couple the rotating stage set 20 with the antenna module 30. Thus the rotating stage set 20 can swivel relative to the host shell 12 about the X-axis, and the antenna module 30 can swivel relative to the rotating stage set 20 about the Y-axis. In addition, as the arched trough 1222 mates with the arch edge 222, the rotating stage set 20 can be swiveled smoothly without hindrance. Refer to FIG. 1A for the coordinate directions.

Figure 4A:
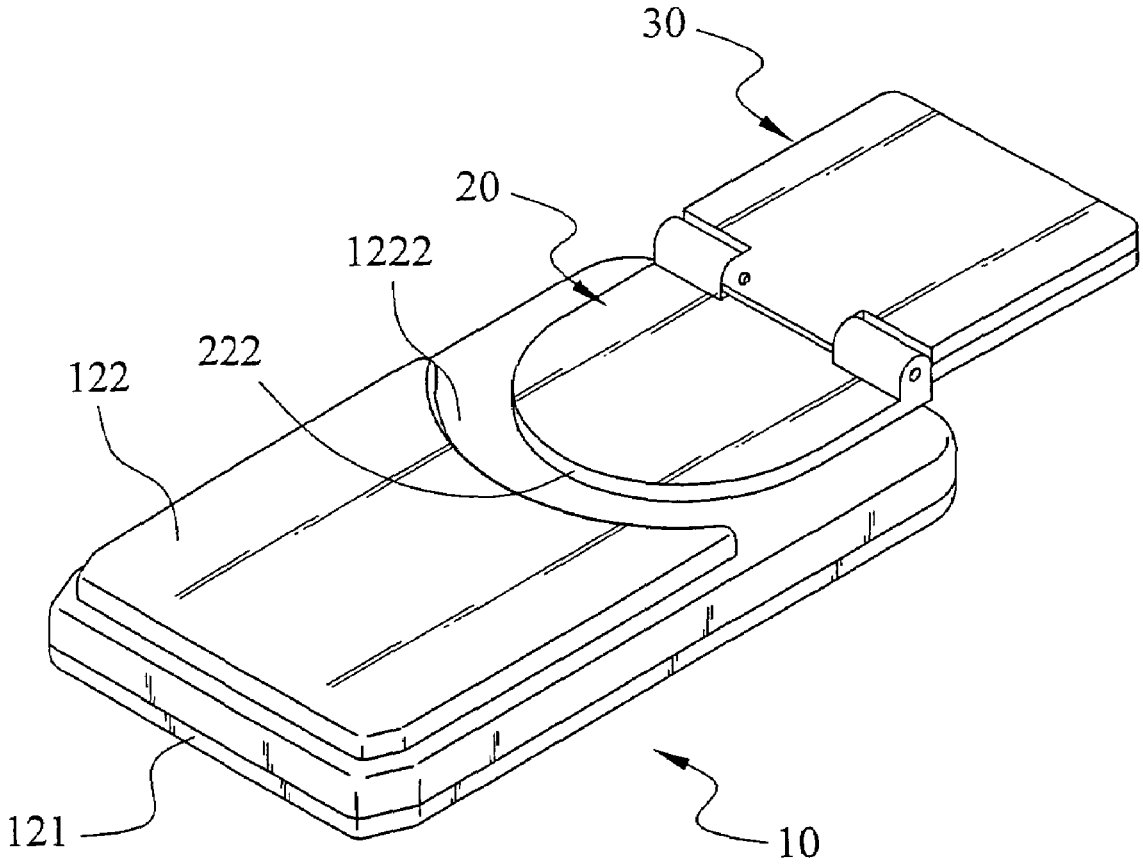
FIGS. 4A, 4B, and 4C are rear, front, and schematic views of the first embodiment of the invention showing the rotating stage set positioned at a selected position and angle and the positioning relationship between the anchor lug and other elements.
Figure 4B:
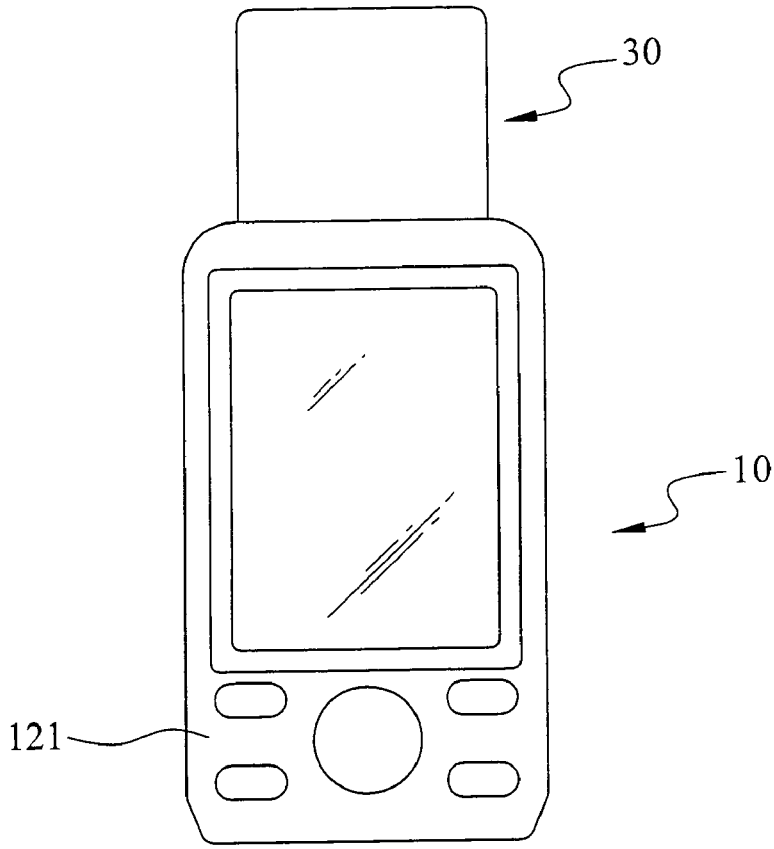
Figure 4C:
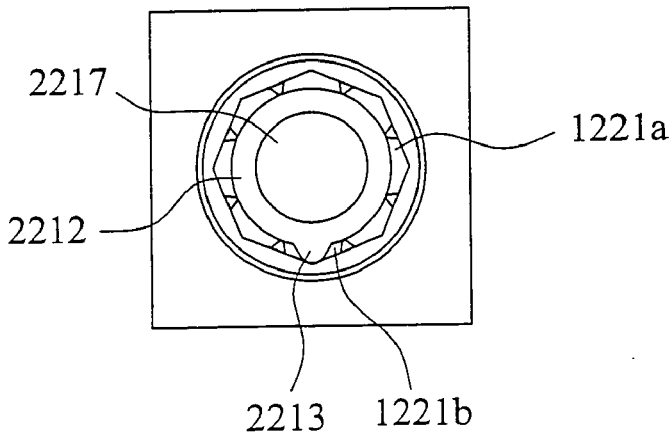

Referring to FIG. 3, a perspective view of an embodiment of the invention in an assembled condition is shown. FIGS. 4A, 4B and 4C, respectively, are rear, front, and schematic views of the first embodiment of the invention showing the rotating stage set positioned at a selected position and angle and the positioning relationship between the anchor lug and other elements. When in use, swivel the antenna module 30 relative to the rotating stage set 20 to a desired angle. The anchor lug 2213 is latched on a selected anchor notch 1221*b*, so the antenna module 30 is positioned on the upper side of the host shell 12.

Figure 5A:
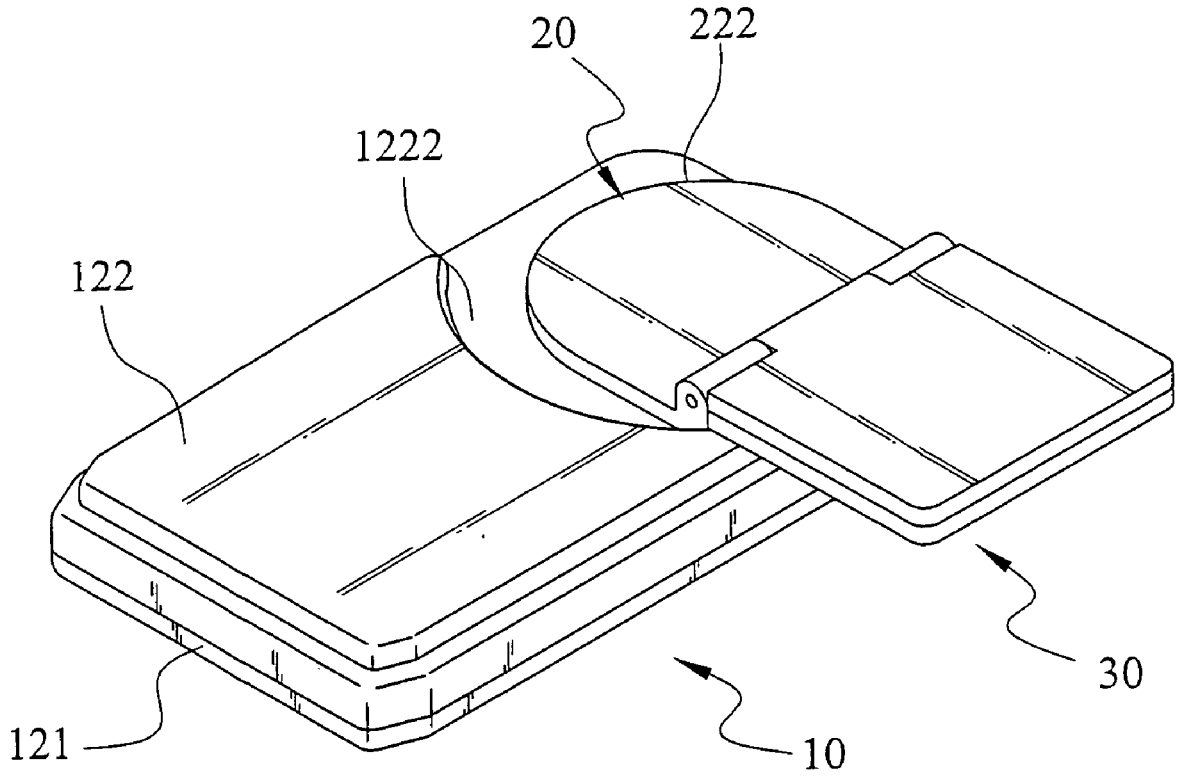
FIGS. 5A, 5B, and 5C are rear, front, and schematic views of the first embodiment of the invention showing the rotating stage set positioned at another selected position and angle and the positioning relationship between the anchor lug and other elements.
Figure 5B:
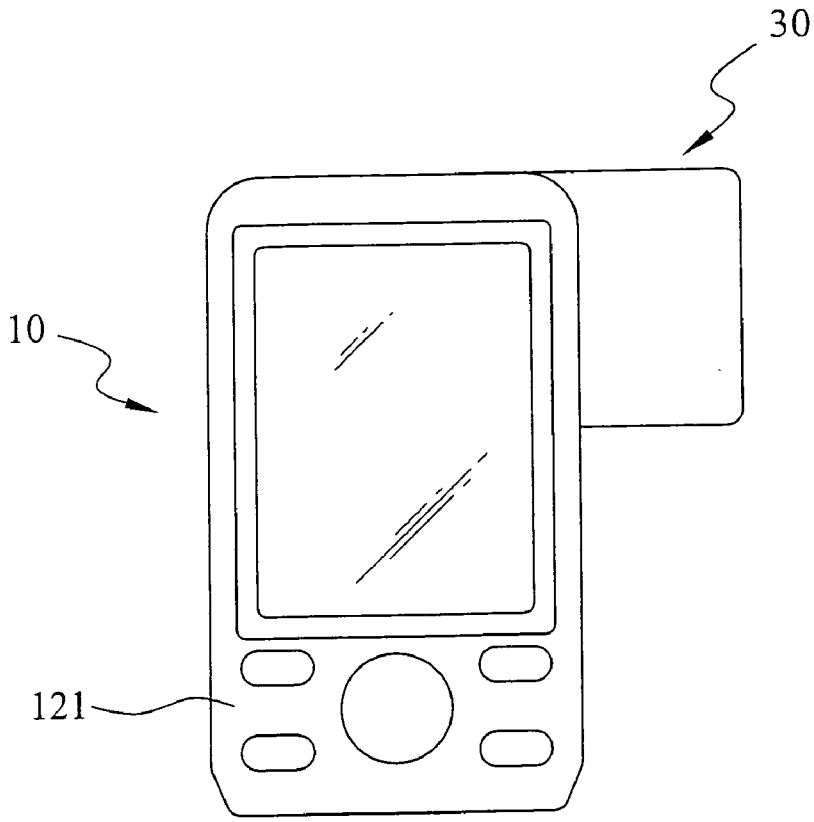
Figure 5C:
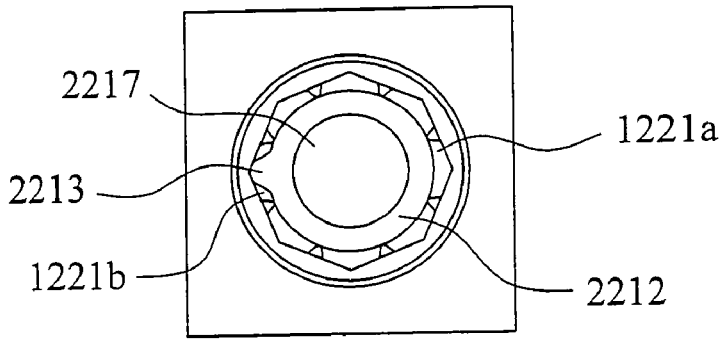

FIGS. 5A, 5B, and 5C, respectively, are rear, front, and schematic views of the first embodiment of the invention showing the rotating stage set positioned at another selected position and angle and the positioning relationship between the anchor lug and other elements. After the antenna module 30 has been rotated, swivel the rotating stage set 20 to the right side of the host shell 12 (based on the rear view shown in FIG. 5A) at another angle. The anchor lug 2213 is latched on another selected anchor notch 1221*b*. Thus the antenna module 30 is positioned on the right side of the host shell 12.

Figure 6A:
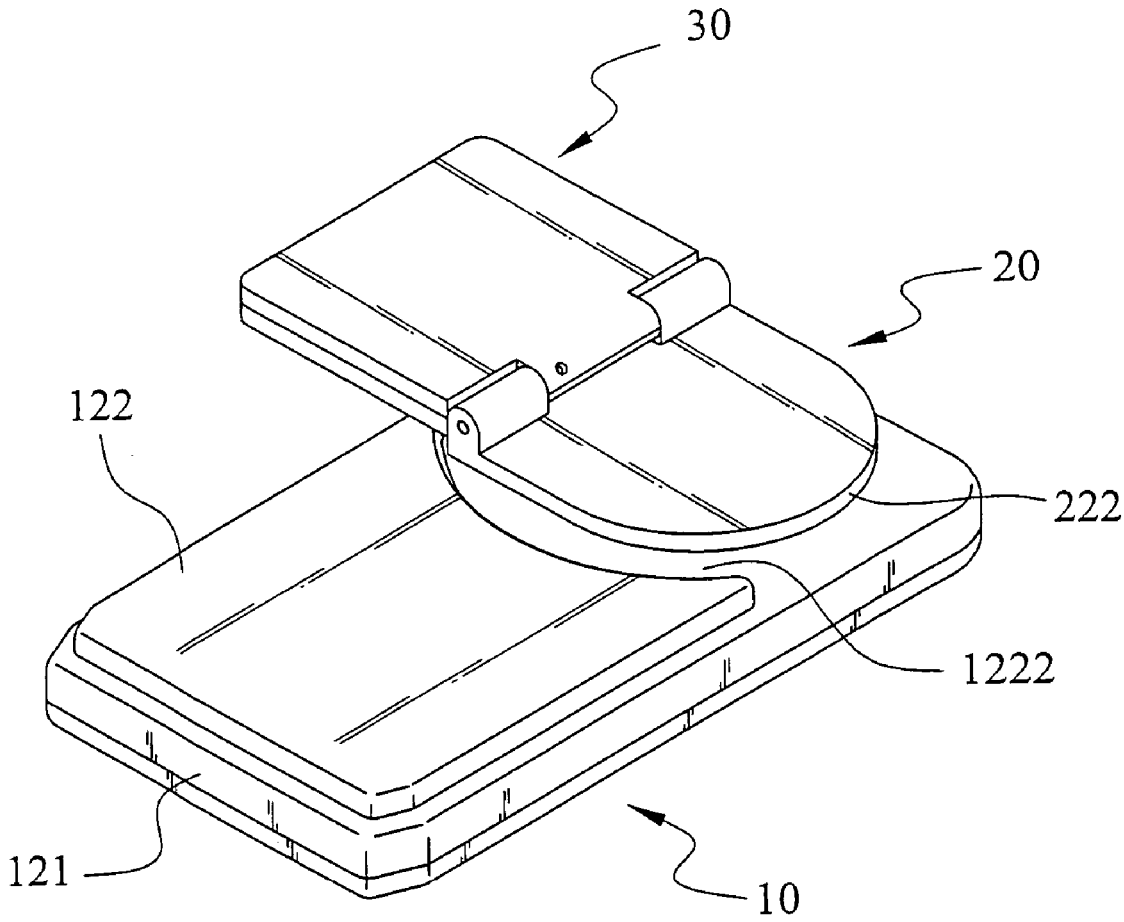
FIGS. 6A, 6B, and 6C are rear, front, and schematic views of the first embodiment of the invention showing the rotating stage set positioned at yet another selected position and angle and the positioning relationship between the anchor lug and other elements.
Figure 6B:
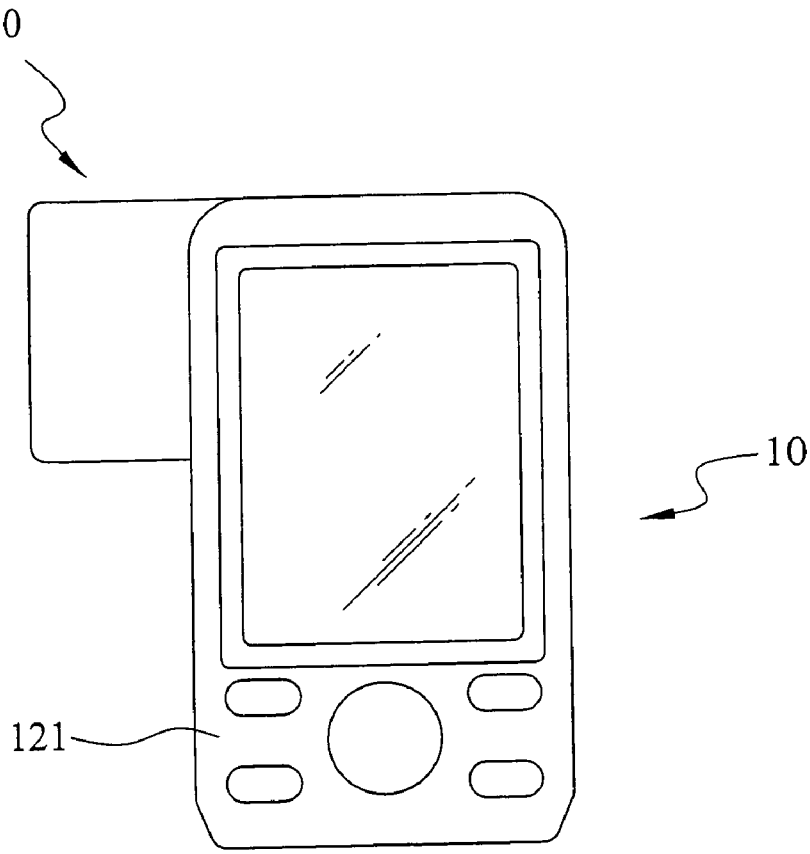
Figure 6C:
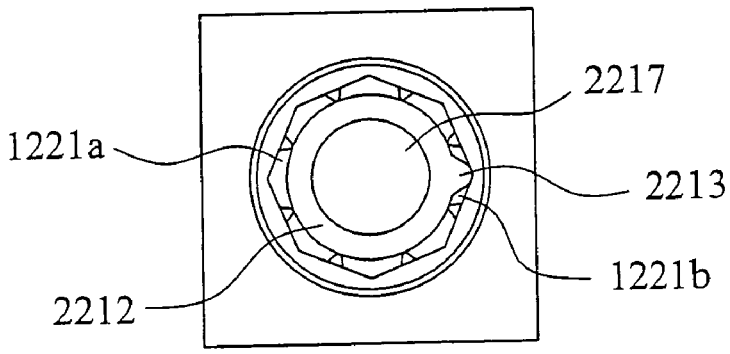

Similarly, FIGS. 6A, 6B, and 6C are rear, front, and schematic views of the first embodiment of the invention showing the rotating stage set positioned at yet another selected position and angle and the positioning relationship between the anchor lug and other elements. After the antenna module 30 has been rotated, swivel the rotating stage set 20 to the left side of the host shell 12 (based on the rear view shown in FIG. 6A) at another angle. The anchor lug 2213 is latched on yet another selected anchor notch 1221*b*. Thus the antenna module 30 is positioned on the left side of the host shell 12.

Figure 7:
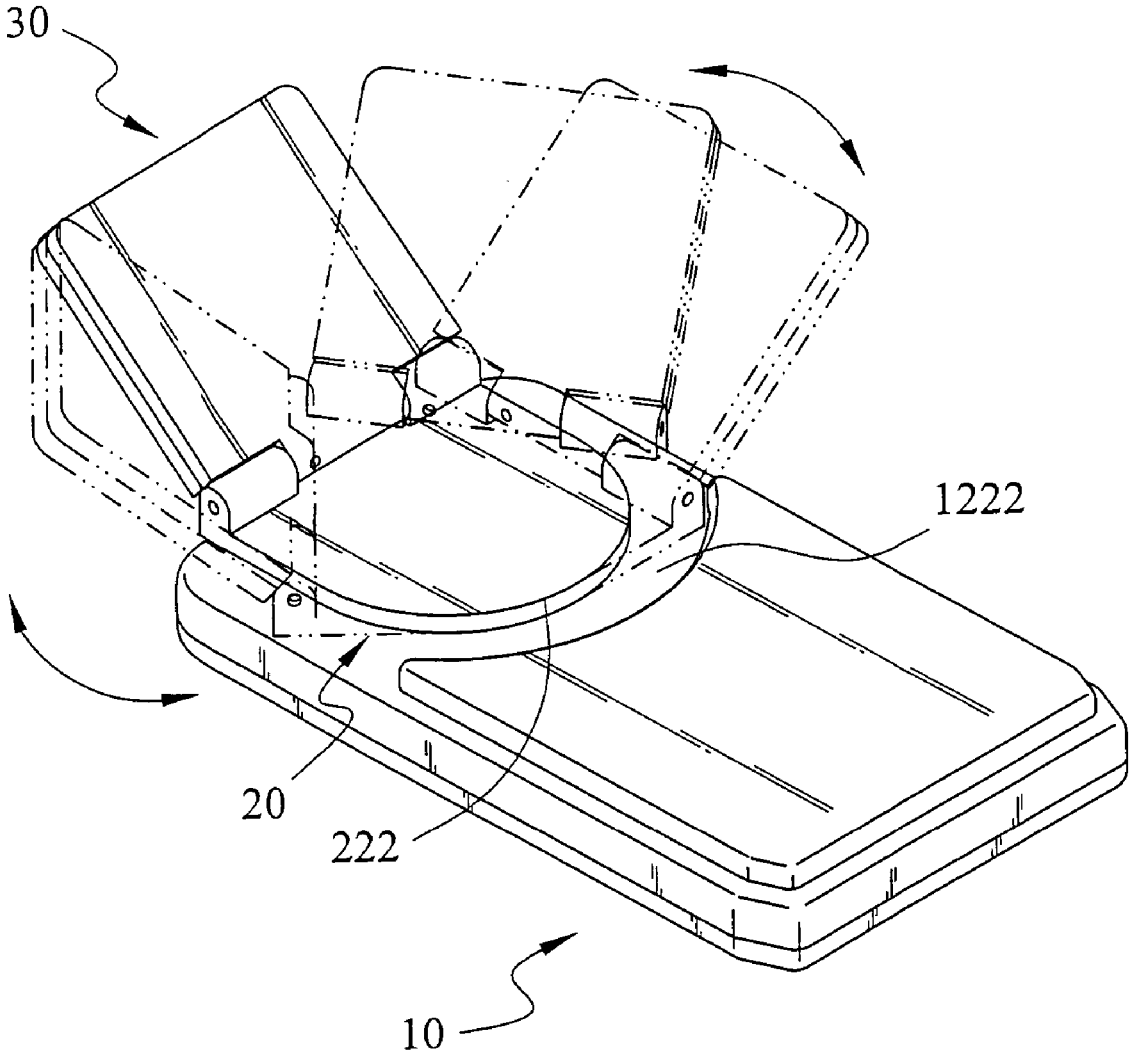
FIG. 7 is a schematic view of an embodiment of the invention showing the rotating stage set positioned at various angles.

As there are multiple anchor notches 1221*b*, the anchor lug 2213 can be latched on different anchor notches 1221*b* to allow the rotating stage set 20 to be positioned and anchored at different angles. Hence the rotating stage set 20 can provide a plurality of positioning angles for user selection. Such a design enables the antenna module 30 to be driven by the rotating stage set 20 and swiveled to a desired angle so that the antenna module 30 can be adjusted to the optimum position and angle for receiving and transmitting to achieve maximum signal receiving and transmitting efficiency. Refer to FIG. 7 for a schematic view of an embodiment of the invention with the rotating stage set swiveled at various angles.

In general, in order to transmit signals between the host 11 of the host module 10 and the antenna 33 of the antenna module 30, the host 11 and the antenna 33 are linked by a connection line (not shown in the drawings). In the invention, the connection line linking to the host 11 is threaded through a first wiring port 2217, the pivot aperture 1221*a* and a second wiring port 2218 formed on the pivot spot 221 of the rotary lower lid 22. The connection line then passes through a wire groove 224 on the rotary lower lid 22 (referring to FIG. 1A) and a wire hole 3212 on the shaft 321 of the lower cap 32 to connect to the antenna 33.

Figure 8A:
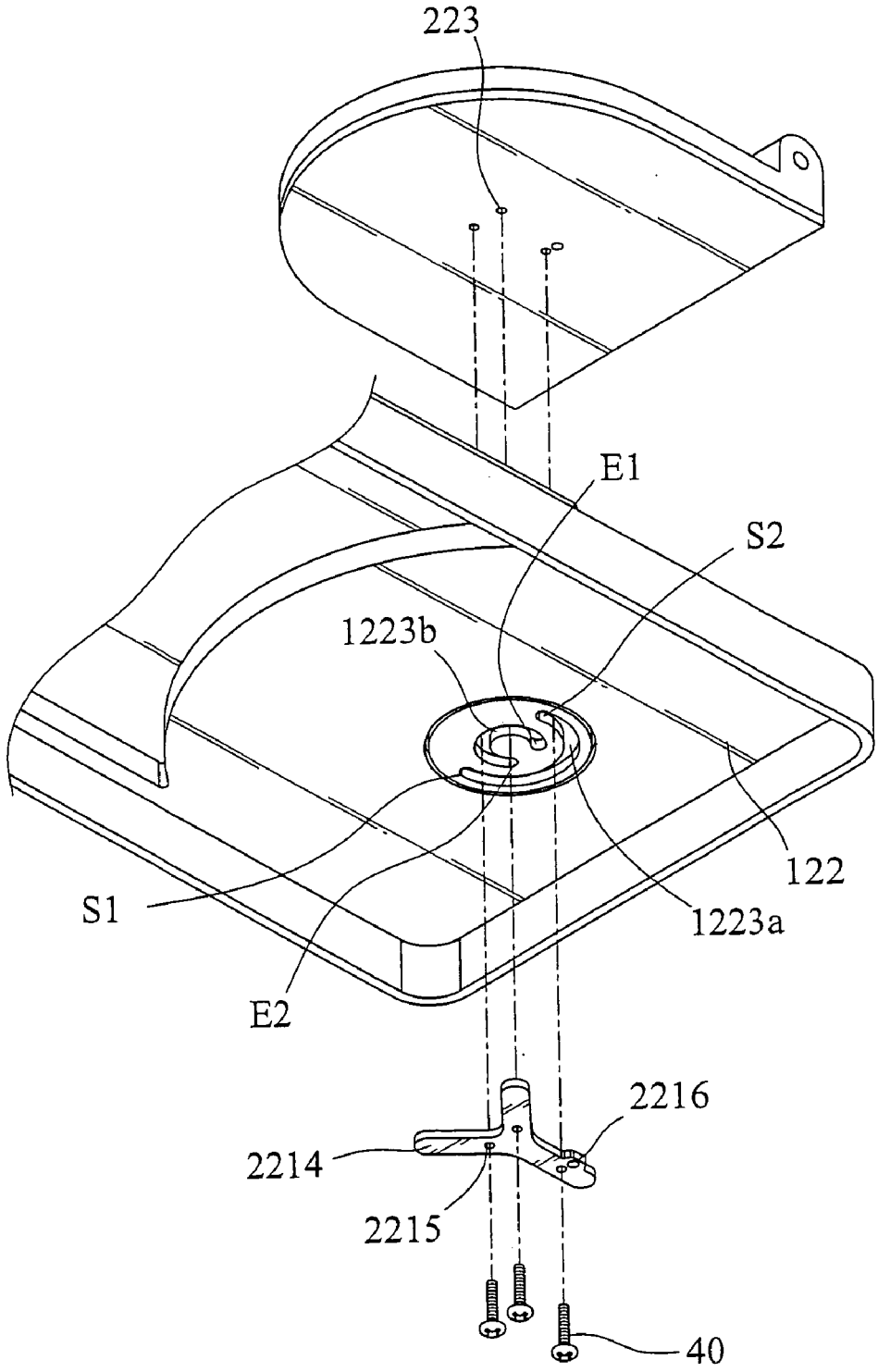
FIG. 8A is an exploded view of an embodiment of the invention showing a coupling method of the rotating stage set and the back cover.
Figure 8B:
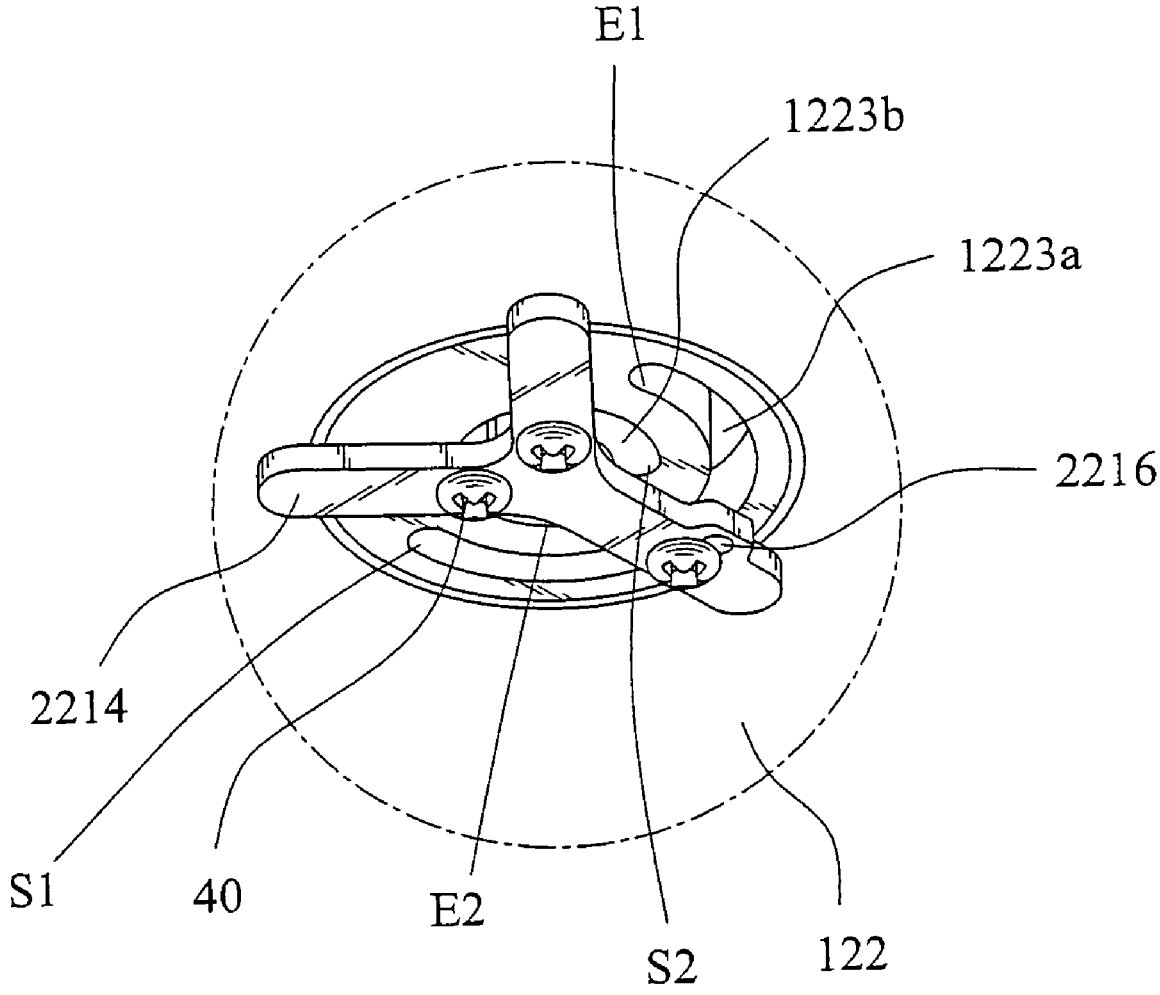
FIG. 8B is a schematic view of an embodiment of the invention showing the rotating stage set and the back cover in a coupled condition.

FIG. 8A shows an exploded view of an embodiment of the invention showing a coupling method of the rotating stage set and the back cover and FIG. 8B shows a schematic view of an embodiment of the invention showing the rotating stage set and the back cover in a coupled condition. The back cover 122 has a first restraint slot 1223*a* and a second restraint slot 1223*b*. In addition, the first restraint slot 1223*a* has a first start point S1 and a first stop point E1 and the second restraint slot 1223*b* has a second start point S2 and a second stop point E2 corresponding respectively to the first start point S1 and the first stop point E1, as shown in FIG. 9C. The rotating stage set 20 has a restraint member 2214 pivotally coupled on the rotary lower lid 22 corresponding to the first restraint slot 1223*a* and the second restraint slot 1223*b*. Also, the restraint member 2214 has a first screw hole 2215 and a wire aperture 2216. Movement of the restraint member 2214 is confined by the first restraint slot 1223*a* and the second restraint slot 1223*b*. The rotary lower lid 22 includes a second screw hole 223 corresponding to the first screw hole 2215. Therefore, the rotating stage set 20 and the host shell 12 can be coupled through a screw 40 engaging with the first screw hole 2215 and the second screw hole 223. The restraint member 2214 may also be fastened to the back cover 122. While the rotating stage set 20 is swiveled relative to the host shell 12, the restraint member 2214 limits the swivel angle of the rotating stage set 20.

Figure 9A:
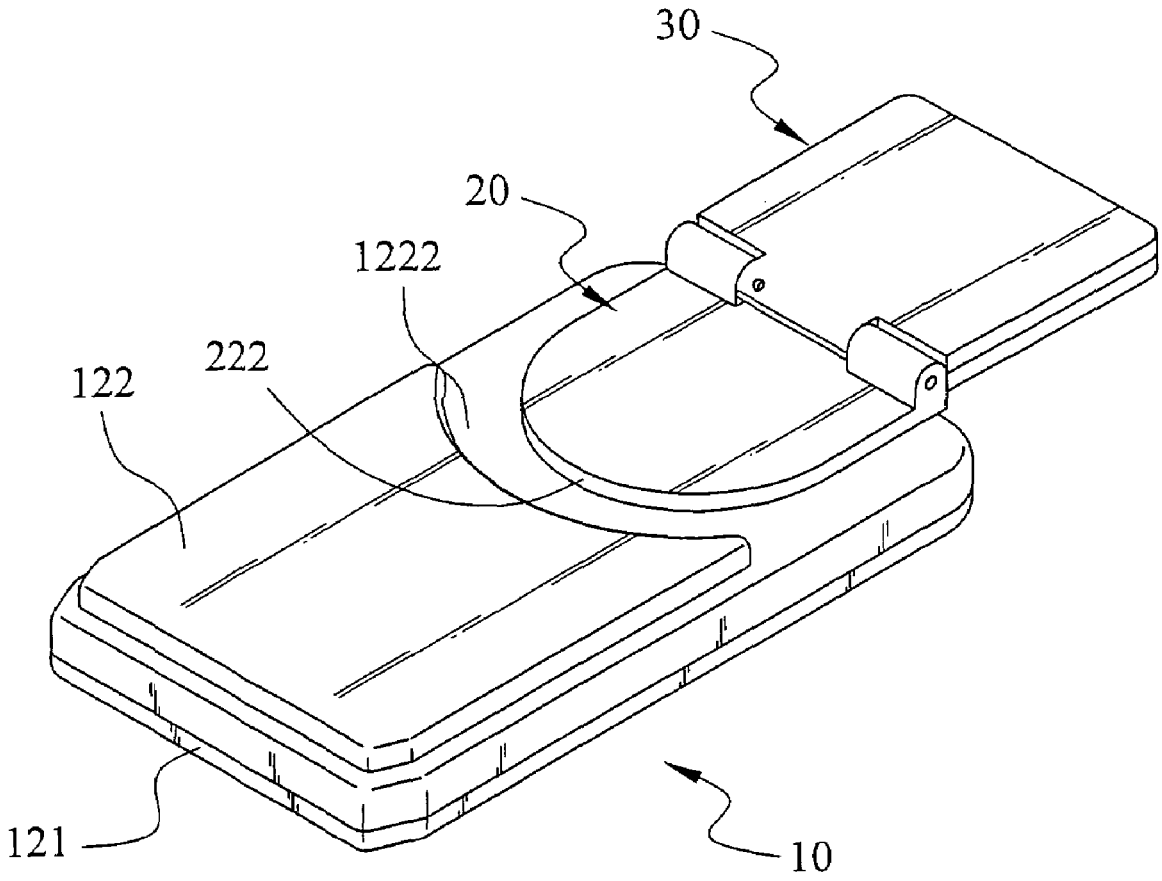
FIGS. 9A, 9B and 9C are rear, front, schematic views of a second embodiment of the invention showing the rotating stage set positioned at a selected angle and the positioning relationship between the anchor lug and other elements.
Figure 9B:
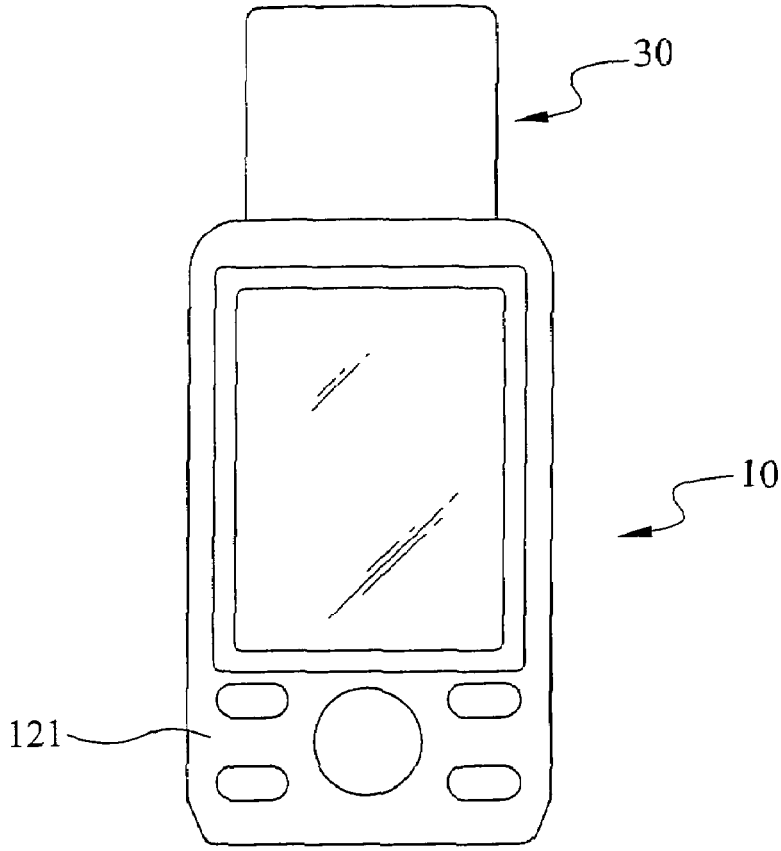
Figure 9C:
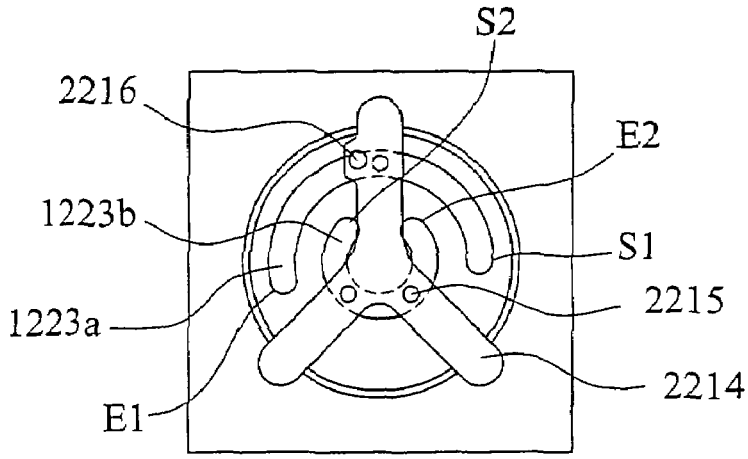

Referring to FIG. 3, a perspective view of an embodiment of the invention in an assembled condition is shown, and FIGS. 9A, 9B and 9C are rear, front, schematic views of a second embodiment of the invention showing the rotating stage set positioned at a selected angle and the positioning relationship between the anchor lug and other elements. When in use, swivel the antenna module 30 relative to the rotating stage set 20 to a desired angle. At this moment, the screw 40 engaging with the first screw hole 2215 of the restraint member 2214 is located in the first restraint slot 1223*a* and the second restraint slot 1223*b*, but is not confined by the start points S1, S2 and stop points E1, E2 of the first restraint slot 1223*a* and the second restraint slot 1223*b*, and the antenna module 30 is located on the upper side of the host shell 12.

Figure 10A:
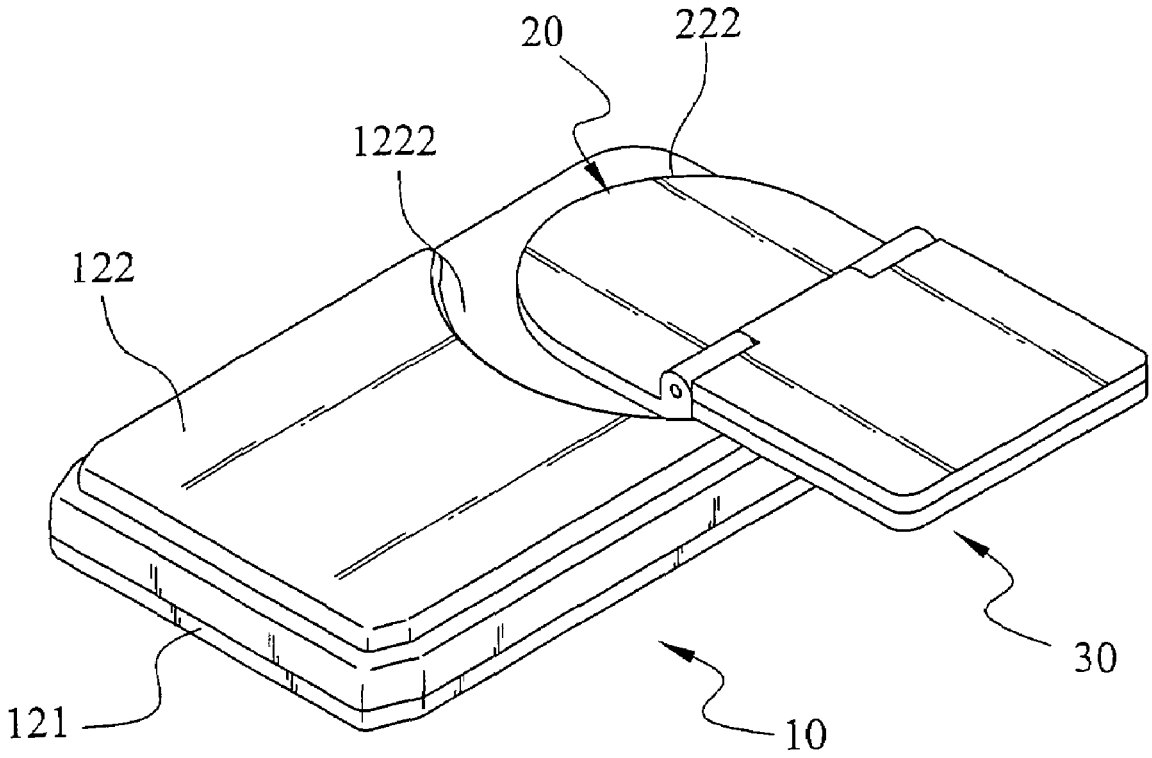
FIGS. 10A, 10B and 10C are rear, front, and schematic views of the second embodiment of the invention showing the rotating stage set positioned at another selected angle and the positioning relationship between the anchor lug and other elements.
Figure 10B:
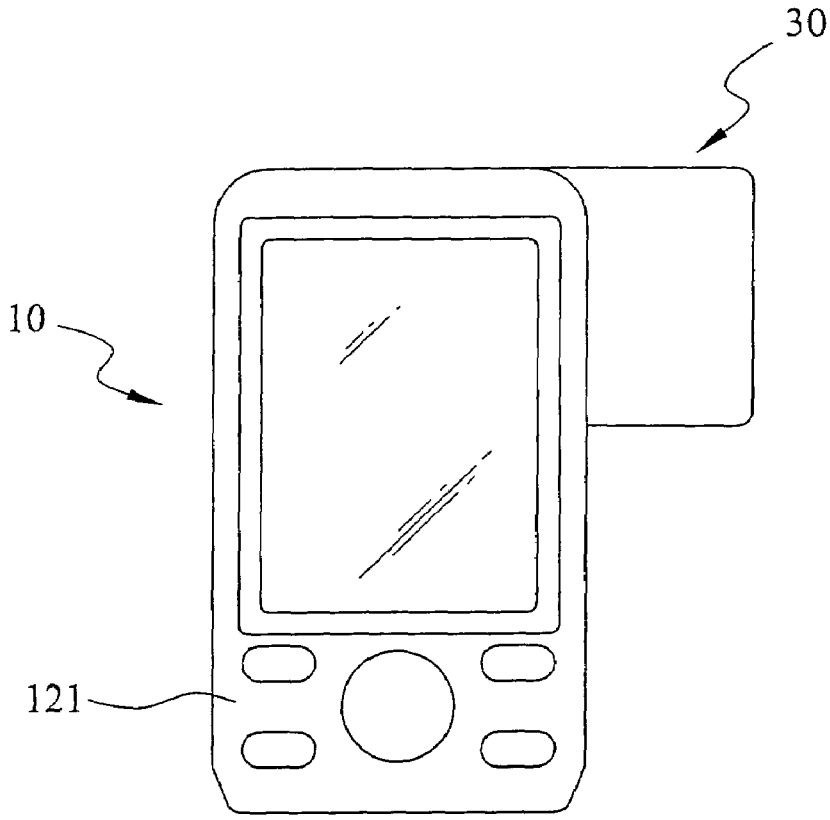
Figure 10C:
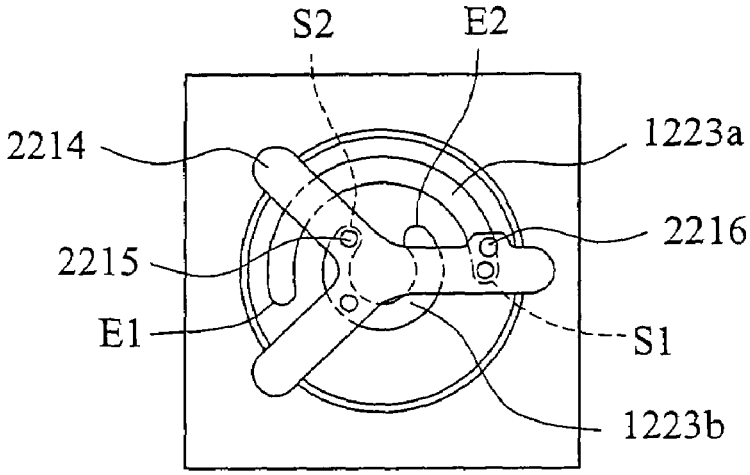

FIGS. 10A, 10B and 10C, respectively, are rear, front, and schematic views of the second embodiment of the invention showing the rotating stage set positioned at another selected angle and the positioning relationship between the anchor lug and other elements. After the antenna module 30 has been rotated, swivel the rotating stage set 20 to the right side of the host shell 12 (based on the rear view shown in FIG. 10A) at another selected angle. At this moment, the screw 40 engaging with the first screw hole 2215 of the restraint member 2214 is located on the first start point S1 of the first restraint slot 1223*a* and the second start point S2 of the second restraint slot 1223*b*, and the antenna module 30 is located to the right side of the host shell 12.

Figure 11A:
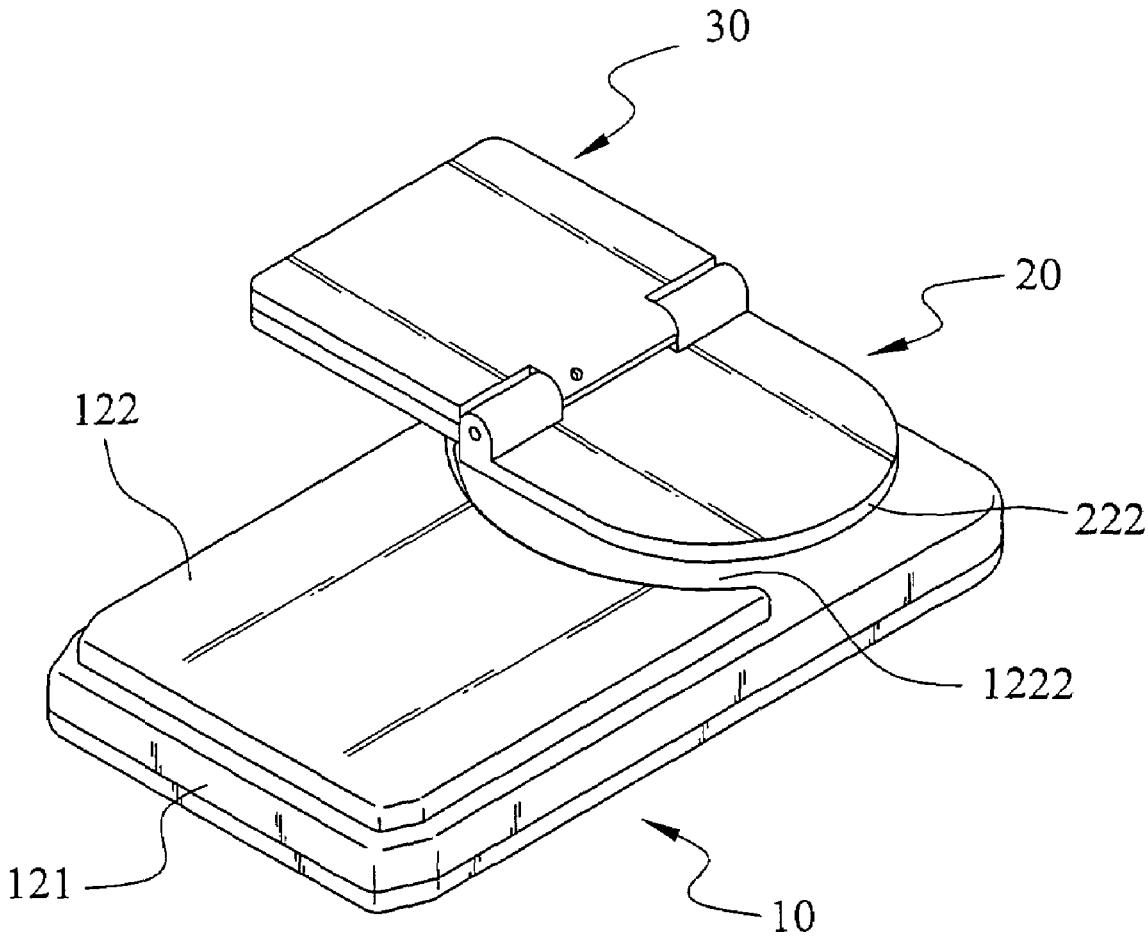
FIGS. 11A, 11B and 11C are rear, front, and schematic views of the second embodiment of the invention showing the rotating stage set positioned at yet another selected angle and the positioning relationship between the anchor lug and other elements.
Figure 11B:
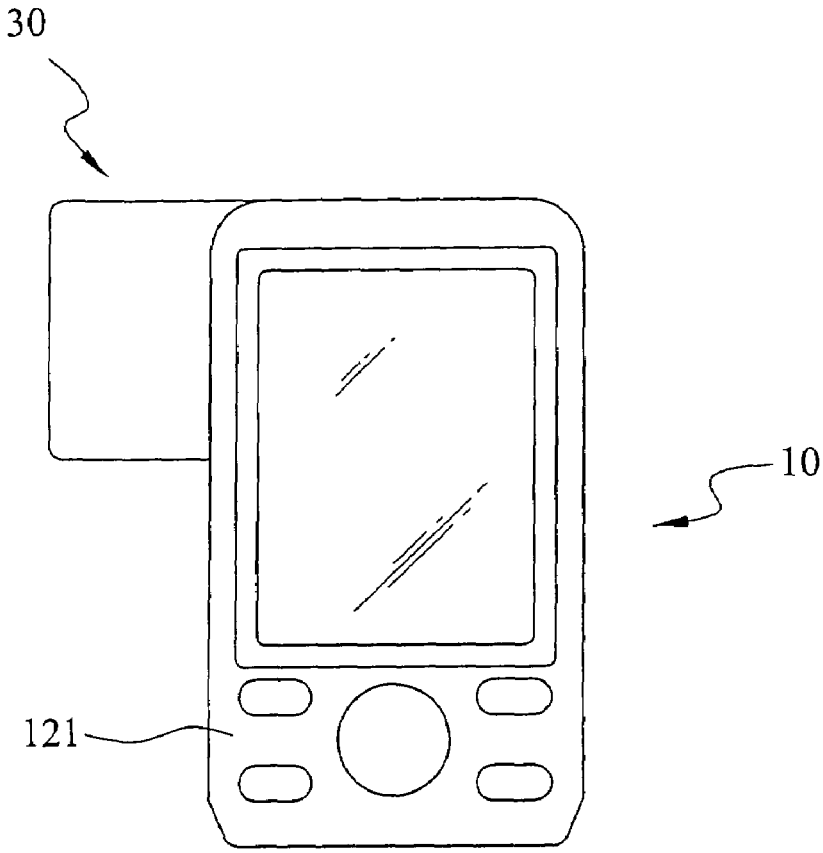
Figure 11C:
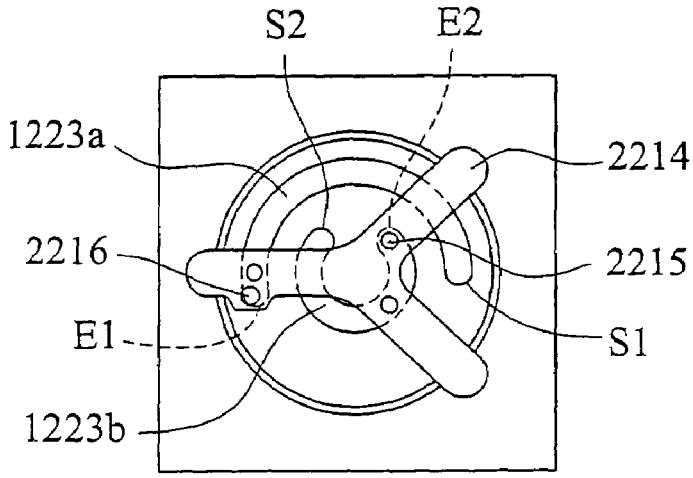

Similarly, FIGS. 11A, 11B and 11C are rear, front, and schematic views of the second embodiment of the invention showing the rotating stage set positioned at yet another selected angle and the positioning relationship between the anchor lug and other elements. After the antenna module 30 has been rotated, swivel the rotating stage set 20 to the left side of the host shell 12 (based on the rear view shown in FIG. 11A) at yet another selected angle. At this moment, the screw 40 engaging with the first screw hole 2215 of the restraint member 2214 is located on the first stop point E1 of the first restraint slot 1223*a* and the second stop point E2 of the second restraint slot 1223*b*, and the antenna module 30 is located on the left side of the host shell 12.

In general, in order to transmit signals between the host 11 of the host module 10 and the antenna 33 of the antenna module 30, the host 11 and the antenna 33 are linked by a connection line (not shown in the drawings). In the invention, the connection line linking to the host 11 is threaded through the wire aperture 2216, the first restraint slot 1223*a*, the pivot aperture 1221*a* and the second wiring port 2218 of the pivot spot 221 of the rotary lower lid 22. The connection line then passes through the wire groove 224 on the rotary lower lid 22 (referring to FIG. 1A) and the wire hole 3212 of the shaft 321 of the lower cap 32 to connect to the antenna 33.

What is claimed is:

1. An electrical apparatus, comprising:

a host module which includes:

a host; and a host shell to encase the host, the host shell including a front cover and a back cover coupled to the front cover, the back cover including a pivot aperture;

a rotating stage set which is pivotally coupled on the host shell, the rotating stage set including:

a pivot spot, corresponding to the pivot aperture, hinged on the host shell, to serve as a swivel axis of the rotating stage set so that the rotating stage set can be swiveled relative to the host shell about X-axis;

a coupling portion located on the pivot spot, the coupling portion running through the pivot aperture; and a coupling axle located in the coupling portion; and an antenna module which is hinged on the rotating stage set and swivelable relative to the rotating stage set about Y-axis.

2. The electrical apparatus of claim 1, wherein the coupling axle has an anchor lug, the pivot aperture having a plurality of anchor notches on the perimeter thereof, the anchor lug being engageable with the anchor notches when the rotating stage set is swiveled relative to the host shell to anchor the rotating stage set on the host shell at a selected position.

3. The electrical apparatus of claim 1, wherein the coupling axle has a first wiring port and the coupling portion has a second wiring port to allow a connecting line to pass through.

4. The electrical apparatus of claim 1, wherein the back cover has a first restraint slot and a second restraint slot, and the rotating stage set includes a rotary upper lid, a rotary lower lid, and a restraint member pivotally coupled on the rotary lower lid corresponding to the first restraint slot and the second restraint slot, so as to limit the swivel angle of the rotating stage set when the rotating stage set is swiveled relative to the host shell.

5. The electrical apparatus of claim 4, wherein the restraint member has a first screw hole and a wire hole for threading a connection line, and the rotary lower lid has a second screw hole corresponding to the first screw hole to engage with a screw to couple the rotating stage set with the host shell.

6. The electrical apparatus of claim 4, wherein the rotary lower lid has a wire groove to hold a connection line.

7. The electrical apparatus of claim 1, wherein the back cover has an arched trough corresponding to an arched edge formed on the rotating stage set.

8. The electrical apparatus of claim 1, wherein the rotating stage set includes a rotary upper lid and a rotary lower lid coupled together, the rotary upper lid being pivotally coupled with the antenna module and the rotary lower lid being hinged on the host shell.

9. The electrical apparatus of claim 8, wherein the rotary upper lid includes an axle hub which has a hole.

10. The electrical apparatus of claim 8, wherein the rotary lower lid has a wire groove to hold a connection line.

11. The electrical apparatus of claim 1, wherein the antenna module includes an antenna, an upper cap, a lower cap and a spindle; the upper cap having a pivot plate, the lower cap having a shaft located in the pivot plate, and the spindle running through the pivot plate and the shaft to couple the upper cap and the lower cap so as to form a housing space between the upper cap and the lower cap for accommodating the antenna.

12. The electrical apparatus of claim 11, wherein the upper cap includes an axle hub, the spindle running through the pivot plate, the shaft, and the axle hub to couple the rotating stage set and the antenna module together.

13. The electrical apparatus of claim 11, wherein the pivot plate has a cavity, the shaft has an opening, and the axle hub has a hole that the cavity, the opening, and the hole correspond to one another.

14. The electrical apparatus of claim 11, wherein the shaft has a wire hole to allow a connection line to pass through.

15. An electrical apparatus, comprising:

a host module which includes:

a host; and a host shell, to encase the host, the host shell including:

a front cover; and a back cover, which is coupled to the front cover and has a first restraint slot and a second restraint slot;

a rotating stage set which is pivotally coupled on the host shell and includes:

a pivot spot, hinged on the host shell, to serve as a swivel axis of the rotating stage set so that the rotating stage set can be swiveled relative to the host shell about X-axis;

a rotary upper lid;

a rotary lower lid; and a restraint member, pivotally coupled on the rotary lower lid corresponding to the first restraint slot and the second restraint slot, so as to limit the swivel angle of the rotating stage set when the rotating stage set is swiveled relative to the host shell; and an antenna module which is hinged on the rotating stage set and swivelable relative to the rotating stage set about Y-axis.

16. The electrical apparatus of claim 15, wherein the restraint member has a first screw hole and a wire hole for threading a connection line, and the rotary lower lid has a second screw hole corresponding to the first screw hole to engage with a screw to couple the rotating stage set with the host shell.

17. The electrical apparatus of claim 15, wherein the rotary lower lid has a wire groove to hold a connection line.

18. The electrical apparatus of claim 15, wherein the back cover has an arched trough corresponding to an arched edge formed on the rotating stage set.

19. The electrical apparatus of claim 15, wherein the rotary upper lid and the rotary lower lid are coupled together, the rotary upper lid being pivotally coupled with the antenna module, and the rotary lower lid being hinged on the host shell.

20. The electrical apparatus of claim 19, wherein the rotary upper lid includes an axle hub which has a hole.

21. The electrical apparatus of claim 19, wherein the rotary lower lid has a wire groove to hold a connection line.

22. The electrical apparatus of claim 15, wherein the antenna module includes an antenna, an upper cap, a lower cap and a spindle; the upper cap having a pivot plate, the lower cap having a shaft located in the pivot plate, and the spindle running through the pivot plate and the shaft to couple the upper cap and the lower cap so as to form a housing space between the upper cap and the lower cap for accommodating the antenna.

23. The electrical apparatus of claim 22, wherein the upper cap includes an axle hub, the spindle running through the pivot plate, the shaft, and the axle hub to couple the rotating stage set and the antenna module together.

24. The electrical apparatus of claim 22, wherein the pivot plate has a cavity, the shaft has an opening, and the axle hub has a hole that the cavity, the opening, and the hole correspond to one another.

25. The electrical apparatus of claim 22, wherein the shaft has a wire hole to allow a connection line to pass through.

26. An electrical apparatus, comprising:

a host module which includes:

a host; and a host shell to encase the host, the host shell including:

a front cover; and a back cover, coupled to the front cover;

a rotating stage set which is pivotally coupled on the host shell and includes:

a pivot spot, hinged on the host shell, to serve as a swivel axis of the rotating stage set so that the rotating stage set can be swiveled relative to the host shell about X-axis; and an antenna module which is hinged on the rotating stage set and swivelable relative to the rotating stage set about Y-axis;

wherein the back cover has an arched trough corresponding to an arched edge formed on the rotating stage set.

27. The electrical apparatus of claim 26, wherein the rotating stage set includes a rotary upper lid and a rotary lower lid coupled together, the rotary upper lid being pivotally coupled with the antenna module and the rotary lower lid being hinged on the host shell.

28. The electrical apparatus of claim 27, wherein the rotary upper lid includes an axle hub which has a hole.

29. The electrical apparatus of claim 27, wherein the rotary lower lid has a wire groove to hold a connection line.

30. The electrical apparatus of claim 26, wherein the antenna module includes an antenna, an upper cap, a lower cap and a spindle; the upper cap having a pivot plate, the lower cap having a shaft located in the pivot plate, and the spindle running through the pivot plate and the shaft to couple the upper cap and the lower cap so as to form a housing space between the upper cap and the lower cap for accommodating the antenna.

31. The electrical apparatus of claim 30, wherein the upper cap includes an axle hub, the spindle running through the pivot plate, the shaft, and the axle hub to couple the rotating stage set and the antenna module together.

32. The electrical apparatus of claim 30, wherein the pivot plate has a cavity, the shaft has an opening, and the axle hub has a hole that the cavity, the opening, and the hole correspond to one another.

33. The electrical apparatus of claim 30, wherein the shaft has a wire hole to allow a connection line to pass through.

34. An electrical apparatus, comprising:

a host module which includes a host and a host shell to encase the host;

a rotating stage set which is pivotally coupled on the host shell and includes:

a pivot spot, hinged on the host shell, to serve as a swivel axis of the rotating stage set so that the rotating stage set can be swiveled relative to the host shell about X-axis;

a rotary upper lid, pivotally coupled with the antenna module; and a rotary lower lid, coupled to the rotary upper lid and hinged on the host shell; and an antenna module which is hinged on the rotating stage set and swivelable relative to the rotating stage set about Y-axis.

35. The electrical apparatus of claim 34, wherein the rotary upper lid includes an axle hub which has a hole.

36. The electrical apparatus of claim 34, wherein the rotary lower lid has a wire groove to hold a connection line.

37. The electrical apparatus of claim 34, wherein the antenna module includes an antenna, an upper cap, a lower cap and a spindle; the upper cap having a pivot plate, the lower cap having a shaft located in the pivot plate, and the spindle running through the pivot plate and the shaft to couple the upper cap and the lower cap so as to form a housing space between the upper cap and the lower cap for accommodating the antenna.

38. The electrical apparatus of claim 37, wherein the upper cap includes an axle hub, the spindle running through the pivot plate, the shaft, and the axle hub to couple the rotating stage set and the antenna module together.

39. The electrical apparatus of claim 37, wherein the pivot plate has a cavity, the shaft has an opening, and the axle hub has a hole that the cavity, the opening, and the hole correspond to one another.

40. The electrical apparatus of claim 37, wherein the shaft has a wire hole to allow a connection line to pass through.

41. An electrical apparatus, comprising:

a host module which includes a host and a host shell to encase the host;

a rotating stage set which is pivotally coupled on the host shell and includes:

a pivot spot, hinged on the host shell, to serve as a swivel axis of the rotating stage set so that the rotating stage set can be swiveled relative to the host shell about X-axis; and an antenna module which is hinged on the rotating stage set, is swivelable relative to the rotating stage set about Y-axis, and includes:

an antenna;

an upper cap, having a pivot plate;

a lower cap, having a shaft located in the pivot plate; and a spindle, to run through the pivot plate and the shaft to couple the upper cap and the lower cap so as to form a housing space between the upper cap and the lower cap for accommodating the antenna.

42. The electrical apparatus of claim 41, wherein the upper cap includes an axle hub, the spindle running through the pivot plate, the shaft, and the axle hub to couple the rotating stage set and the antenna module together.

43. The electrical apparatus of claim 41, wherein the pivot plate has a cavity, the shaft has an opening, and the axle hub has a hole that the cavity, the opening, and the hole correspond to one another.

44. The electrical apparatus of claim 41, wherein the shaft has a wire hole to allow a connection line to pass through.

* * * * *